United States Patent [19]

Brunello et al.

[11] Patent Number: 4,528,891

[45] Date of Patent: Jul. 16, 1985

[54] FIRING CONTROL SYSTEM FOR A DIRECT FIRING WEAPON MOUNTED ON A ROTARY-WING AIRCRAFT

[75] Inventors: Alain M. Brunello, Marseille; Guy G. Catani, Vitrolles, both of France

[73] Assignee: Societe Nationale Industrielle Aerospatiale, Paris, France

[21] Appl. No.: 425,392

[22] Filed: Sep. 28, 1982

[30] Foreign Application Priority Data

Oct. 14, 1981 [FR] France ..... 81 19344

[51] Int. Cl.[3] ..... F41G 5/18

[52] U.S. Cl. ..... 89/41.21; 89/41.05; 356/252; 364/423

[58] Field of Search ..... 89/41 E, 41 EA, 41 AA, 89/41 L, 41 TV; 356/29, 152, 252; 364/423; 250/203 CT; 358/108, 109, 125, 126

[56] References Cited

U.S. PATENT DOCUMENTS

| | | | |
|---|---|---|---|
| 2,455,963 | 12/1948 | Wheeler | 89/41 AA |
| 2,724,998 | 11/1955 | Goertz et al. | 89/41 SW |
| 3,383,987 | 5/1968 | MacMillan | 89/41 EA |
| 3,641,261 | 2/1972 | Chaplin et al. | 89/41 EA |
| 3,828,122 | 8/1974 | McPhee et al. | 250/203 CT |
| 4,004,487 | 1/1977 | Eichweber | 89/41 TV |
| 4,012,989 | 3/1977 | Hunt et al. | 89/41 EA |
| 4,020,324 | 4/1977 | Buscher et al. | 356/29 |
| 4,146,780 | 3/1979 | Sprey | 89/41 AA |
| 4,312,262 | 1/1982 | Tye | 89/41 EA |
| 4,393,597 | 7/1983 | Picard et al. | 89/41 EA |
| 4,404,890 | 9/1983 | McAlpine | 89/41 E |

FOREIGN PATENT DOCUMENTS 2480424 10/1981 France .

*Primary Examiner*—Stephen C. Bentley

*Attorney, Agent, or Firm*—Marshall, O'Toole, Gerstein, Murray & Bicknell

[57] ABSTRACT

Firing control system for a direct firing weapon mounted on a rotary-wing aircraft, which is designed to be actuated by the pilot himself and comprises an electronic computer, the said weapon being mounted for rotating about two transverse axes Y–Y′ and Z–Z′, due to driving means controlled by the said computer.

According to the invention, said firing control system is characterized in that it comprises a sighting system on which a target and an adjusting mark can appear simultaneously, which adjusting mark can be moved on the said sighting system by a control of the pilot, as well as means to determine the coordinates of the position of the said adjusting mark with respect to a system of axes tied to the aircraft and to transmit them to said electronic computer at least when the said adjusting mark is brought to a position on the said sight finder where it is superposed on the said target.

8 Claims, 2 Drawing Figures

PILOT
GYROMETER
GYROSCOPE
ANEMOMETRIC SENSOR
COMPUTER
RANGE
L, L'
Ea
Eb
Ca
Cb

FIRING CONTROL SYSTEM FOR A DIRECT FIRING WEAPON MOUNTED ON A ROTARY-WING AIRCRAFT

The present invention relates to a firing control system for a direct firing weapon, for example a cannon, mounted on a rotary wing aircraft, such as a helicopter.

It is known that the firing control for a cannon mounted on a plane has been the subject of many studies. On the contrary, the firing control of a cannon mounted on a helicopter is a relatively new field in which the research which has been conducted relatively to planes cannot be just simply transposed. Indeed, on the one hand, the special flying characteristics of a helicopter and, on the other hand, the possibilities of providing on a helicopter a firing assembly movable about two axes, rectangular axes for example, differentiates the firing control of a weapon mounted on a helicopter from that of the same weapon mounted on a plane (where the weapon is generally mounted on axes which are fixed with respect to the fuselage).

Also on a combat helicopter, and contrary to what happens on a fighter plane, the cannon which is generally mounted on a turret so as to be adjustable in sight and in bearing with wide angular deflections, cannot be controlled by the pilot, unless special provisions are made; such additional duties would interfere with the control of the helicopter, of which it is known that the natural flying instabilities makes flying control much more difficult and engrossing than that of a conventional plane. Consequently, with this type of armed helicopter, the cannon is usually aimed either by the co-pilot, or by a specially appointed gun-crew.

It is the object of the present invention to propose a firing control system for a direct firing weapon mounted on a rotary-wing aircraft, which is designed to be operated by the pilot himself and permits a total decoupling between the aim taken by the pilot and the firing corrections.

This object is achieved according to the invention with a firing control system for a direct firing weapon mounted on a rotary-wing aircraft, adapted to be controlled by the pilot himself and incorporating an electronic computer, said weapon being mounted for rotation about two transverse axes due to driving means controlled by the said computer, which system is remarkable in that it comprises a sighting system on which a target and an adjusting mark can appear simultaneously, which adjusting mark can be moved on the sighting system by a control of the pilot, and means to determine the coordinates of the position of the adjusting mark with respect to a system of axes linked to the aircraft and to transmit them to the said computer at least when, on the said sighting system, the said adjusting mark is superposed on the said target.

Preferably, the sighting system is of the semi-transparent mirror type showing the target by transparency and reproducing the image of a luminous symbol generated by an electrooptical device, such as for example a cathode screen, the said image constituting the adjusting mark, whereas the electrooptical device constitutes the means to determine the coordinates of the adjusting mark and to transmit them to the computer.

Thus, when the pilot has detected a target, he can direct the axis of his aircraft towards it, with the flying controls, until alignment is more or less achieved and the target appears inside the field of the sighting mirror.

Then the pilot, by continuing to control his aircraft in order to hold and if possible to improve the said alignment, causes the adjusting mark, with the target, to coincide with the sighting system.

Means are provided in said system to indicate to the computer the distance separating the aircraft from the target. These means consist of a display device controlled either by the pilot or by a range-finding device.

Thus, the computer receives the coordinates of the sighting references, i.e. the coordinates of the target when the pilot has obtained a coincidence. The computer also receives an information concerning the distance separating the aircraft from the target. The computer further receives from gyrometers, gyroscopes and/or anemometric sensors on board the aircraft information concerning the attitude and attitude variations of the aircraft, as well as its relative speed with respect to the ambient atmosphere. All this information is used to forecast the movement of the target and to determine what orientation to be given to the weapon.

The computer is programmed to take the movement of the target into account. If accelerations are brought in, then it becomes necessary to measure the distance separating the target from the aircraft and not simply to estimate it.

Thus, according to a simplified embodiment of the system according to the invention, wherein the distance to the target is estimated by the pilot as indicated hereinabove, the computer program presupposes that the target follows a rectilinear path at constant speed (or constant acceleration) throughout the flying time of the projectile fired by the weapon and it enables to define the position to be given to the weapon with respect to a mark linked to the aircraft so that the paths of the target and of the projectile intersect at the same time.

The invention will be more readily understood on reading the following description with reference to the accompanying drawings in which.

Figures 1, 2:
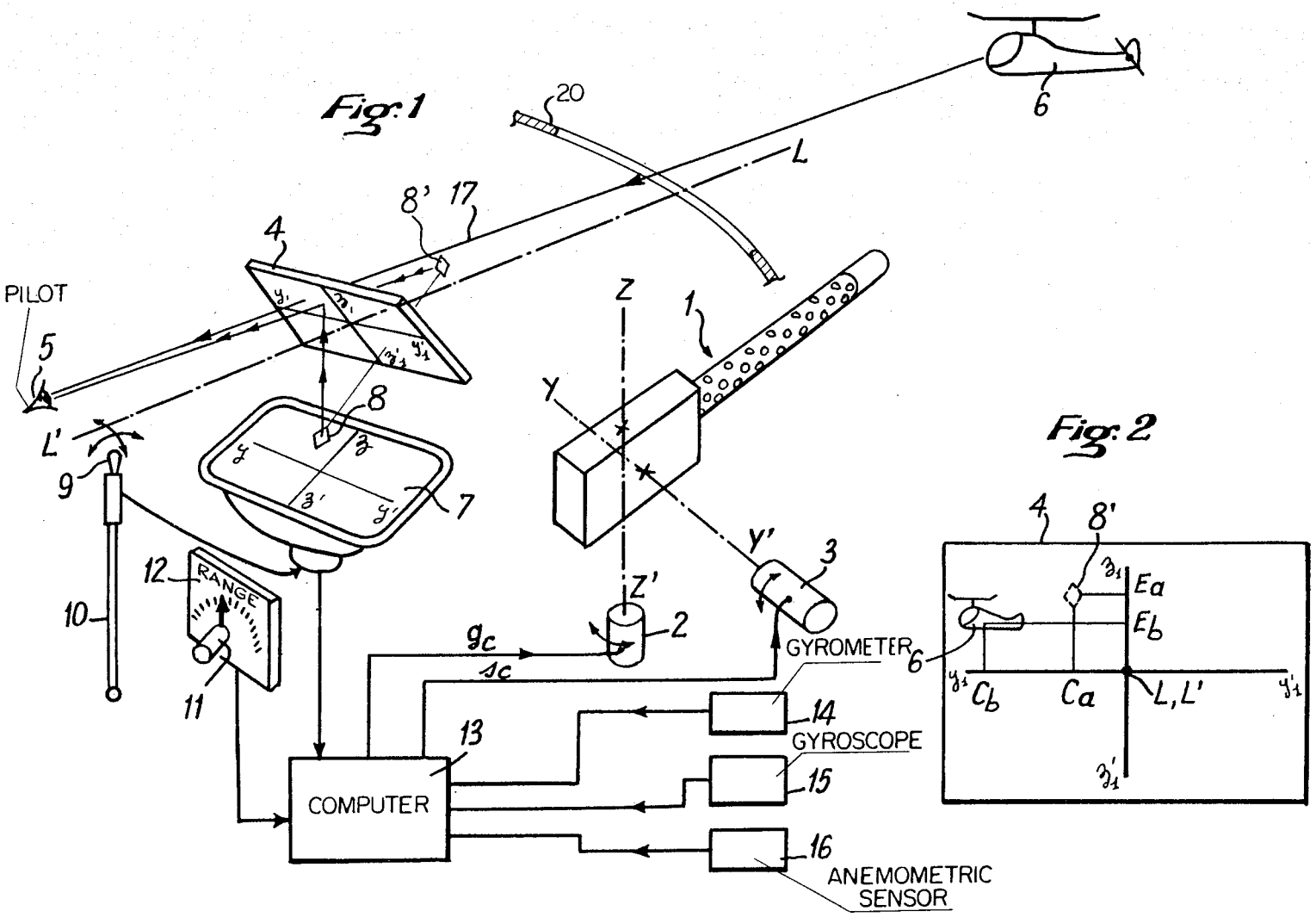
FIG. 1 is a diagrammatical view in perspective of part of an embodiment of the system according to the invention.
FIG. 2 is a front view of the sighting system in the system according to the invention.

Referring now to FIG. 1, this shows a diagrammatical view of the system according to the invention which is designed to control the firing of a cannon 1 mounted on a helicopter (shown schematically at 20) of longitudinal axis L—L'. The cannon 1, which is for example mounted on a turret (not shown) can pivot about a bearing axis Z—Z' and about an axis of sight Y—Y' under the action of motors or jacks 2 and 3, respectively.

Said system comprises a clear sight finder 4 of the semitransparent mirror type, through which the pilot, of whom only one eye 5 is shown in FIG. 1, can see the target 6, which could be an enemy helicopter for example. The center of the sight finder traverses for example the axis L—L' of the helicopter equiped with a system according to the invention or occupies a predetermined fixed position with respect to said axis and the plane of said sight finder is inclined by 45° C. with respect to said axis L—L'.

Under the sight finder 4 there is provided an electro-optical device 7, on which a symbol 8 appears, the disposition being such that the pilot can simultaneously see on the sight finder 4 the target 6 and the image 8' of the symbol 8. The position of the symbol 8 on the screen 7 (and therefore that of the image 8' on the sight finder 4) can be adjusted according to two perpendicular axes Y—Y' and Z—Z' one of which is for example within the vertical plane traversing the axis L—L', by actuating a control switch 9 accessible to the pilot, and mounted for example on the cyclic control stick 10. Two reference axes, engraved for example on the sight finder 4 and respectively designated by $y_1$—$y'_1$ and $z_1$—$z'_1$ enable the pilot to come into alignment with the axis L—L' when he brings the image of axes y—y' and z—z' in optical coincidence on the sight finder 4 with the said reference axes.

Also provided for the use of the pilot are a control knob 11, means 12 for displaying the value to which the pilot estimates the distance separating him from the target 6, when the system does not comprise a range-finder which works out automatically this measurement.

Finally, the system according to the invention comprises a micro-computer 13 connected with the electro-optical device 7, the distance displaying device 12, the aircraft gyrometer 14, the aircraft gyroscope 15 and an anemometric sensor 16 from which it receives information, as well as with the motors 2 and 3 to which it sends orders.

As will be seen hereinafter, the firing control system according to the invention helps the pilot to sight the target 6 and on the other hand enables to decouple the firing corrections from the sighting.

When the pilot has sighted a target 6, he moves the axis L—L' of his aircraft, using his flying controls, until the target 6 comes into the field of his sight finder 4.

Moreover, on said sight finder 4 appears the image 8' of the symbol 8 which represents the pilot's aiming direction.

At first, said aiming direction coincides with the longitudinal axis of the helicopter.

Once the target 6 comes within the field of the sight finder 4, the pilot, using the control knob 9 situated on his cyclic direction-stick 10, will bring the image 8' of the symbol 8 so as to coincide with the target 6. The work of the pilot is then to follow the target with the symbol 8 throughout the whole of the weapon aiming phase and the firing, so as to to constantly keep the coordinates $C_b$, $E_b$ of the target respectively equal to the coordinates $C_a$, $E_a$ of the image 8' (see FIG. 2).

The control knob 9 is a twin-axis knob (sight and bearing) permitting to move the image of the symbol on the sight finder. If the pilot exerts a pressure on the control knob 9, the symbol 8 moves in the corresponding direction. If no pressure is exerted on said knob 9, the image of symbol 8 remains stationary on the sight-finder 4 and therefore indicates a fixed direction within a system of axes attached to the helicopter.

The pilot has two ways to improve and to continue the sighting i.e. with his flying controls and the control knob 9. He uses the latter especially in the case where the flying controls could bring him in dangerous flying conditions.

The digital computer 13 controls the system and calculates the aim to be given to the weapon 1. To calculate this the computer receives measurements:

from the aircraft gyrometer 14 and/or from the specific gyrometers of the sight finder which supply the three components, with respect to a system of axes tied to the helicopter, of the absolute rotation speed of the virtual line helicopter-target.

from the aircraft gyroscopes 15 which give a measurement of the longitudinal range and of the angle of sight.

from anemometric sensors 16 measuring the components of the speed of the helicopter with respect to the atmosphere.

from the electro-optical device 7 which gives the direction of the line of sight 17 with respect to a reference tied to the helicopter in the form of coordinates $E_a$ and $C_a$ (see FIG. 2).

from the device 12 which gives an estimate of the distance separating it from the target 6, which device can be replaced by a range-finder.

All this information is filtered to reach the computer 13 in the same form and at the same frequency.

Said computer processes this information and deduces from it what aim should be given to cannon 1 in order that the shell reaches the target 6. One simple assumption made in the programming of the computer 13 to work out the aim of the weapon 1 is that the target 6 moves in a straight line and at a uniform speed through the course of the shell. If the helicopter is equipped with a range-finder, the acceleration of the target can be taken into account.

The instructions given by the computer 13 indicate the sight sc and the bearing gc to be given to the cannon and are sent to the rotation controls 2 and 3 thereof.

Thus, as long as the pilot keeps the image 8' superposed on the target 6, he is sure that the weapon 1 is aimed accurately, in conformity with the program of the computer 13, and so he can actuate the firing key of the cannon.

In certain cases, the sighting such as presented hereinabove risks to be difficult for the pilot, mainly because of the small movements at high frequency of the helicopter. To this effect, two improvements can be made at the aiming level for more accuracy.

(1) The displacement of symbol 8 is controlled via a twin-axis gyroscope which is left free in sight and which in bearing is controlled to remain around $C_a = O$. The symbol 8 is therefore decoupled from the small movements in bearing. In sight, the pilot can only move his aim with the help of his control knob 9; indeed, the gyroscope is free since not under the pilot's control, therefore it keeps a fixed direction with respect to the ground.

(2) The displacement of the symbol 8 is controlled via a twin-axis gyroscope so that without the pilot's control, the gyroscope is made to keep a fixed direction with respect to the helicopter by being decoupled from the small movements. The big advantage with this type of sight is that without control, the pilot sees a symbol which is stable with respect to the outside landscape and which follows the mean movement of the helicopter. The pilot can improve his sight whilst being at the controls of the helicopter.

We claim:

1. Firing control system for a weapon mounted on an aircraft and firing a projectile which travels in essentially a straight line, said system comprising:

an electronic computer;

mounting means for mounting said weapon on said aircraft for rotation about two transverse axes;

driving means controlled by said computer for rotating said weapon about said axes;

optical sighting means providing a field of view which is fixed relative to said axes and which permits a direct line-of-sight to a target by a pilot of said aircraft;

an electro-optical device generating a luminous mark on a screen which is fixed relative to said axes, the position of said mark on said screen being manually adjustable by said pilot;

means for measuring the coordinates of the position of said mark relative to said axes;

means for projecting an image of said mark onto said field of view in said optical sighting system; and means for transmitting said coordinates to said computer at least when said image is positioned to lie in said line of sight to a target.

2. A system in accordance with claim 1 wherein said optical sighting means comprises a semi-transparent mirror through which said target can be seen and onto which said image can be projected.

3. A system in accordance with claim 1 or claim 2 further including range means for supplying to said computer a range signal representing the distance to a target.

4. A system in accordance with claim 3 wherein said range means is display means under the control of said pilot.

5. A system in accordance with claim 3 wherein said range means is a range-finder.

6. A system in accordance with claim 1 further including means for supplying to said computer signals representative of the attitudes, attitude changes, and air speed of said aircraft.

7. A system in accordance with claim 1 wherein said computer is programmed to assume that a target being tracked in said sighting system is moving in a straight path at constant speed.

8. A system in accordance with claim 1 wherein said computer is programmed to assume that a target being tracked in said sighting system is accelerating at a constant rate.

* * * * *

UNITED STATES PATENT AND TRADEMARK OFFICE

CERTIFICATE OF CORRECTION

PATENT NO. : 4,528,891

DATED : July 16, 1985

INVENTOR(S) : BRUNELLO, ET AL.

It is certified that error appears in the above-identified patent and that said Letters Patent is hereby corrected as shown below:

Column 2, line 61, "45°C" should be --45°--.

Signed and Sealed this

*Seventeenth* Day of *June 1986*

[SEAL]

*Attest:*

DONALD J. QUIGG

*Attesting Officer*

*Commissioner of Patents and Trademarks*